US009343860B2

(12) United States Patent
Zomchek et al.

(10) Patent No.: US 9,343,860 B2
(45) Date of Patent: May 17, 2016

(54) DISTRIBUTION NETWORKS FOR SAFETY SENSORS AND DEVICES

(71) Applicant: Rockwell Automation Technologies, Inc., Mayfield Heights, OH (US)

(72) Inventors: Kevin M. Zomchek, Nashua, NH (US); Brian H. Schriver, Woburn, MA (US); Derek W. Jones, Kirkcudbright (GB); Richard W. Boyd, Holliston, MA (US); James J. Boschuetz, Jr., Hudson, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 695 days.

(21) Appl. No.: 13/736,445

(22) Filed: Jan. 8, 2013

(65) Prior Publication Data

US 2014/0193998 A1 Jul. 10, 2014

(51) Int. Cl.

| | |
|---|---|
| ***H01R 13/00*** | (2006.01) |
| ***H01R 31/00*** | (2006.01) |
| *H01R 13/717* | (2006.01) |
| *H01R 31/08* | (2006.01) |
| *H01R 107/00* | (2006.01) |

(52) U.S. Cl.

CPC ..... *H01R 31/005* (2013.01); *H01R 13/7175* (2013.01); *H01R 31/08* (2013.01); *H01R 2107/00* (2013.01)

(58) Field of Classification Search

CPC .. H01R 31/005; H01R 2107/00; H01R 31/08; H01R 13/7175

USPC ..... 307/326

See application file for complete search history.

(56) References Cited

U.S. PATENT DOCUMENTS

| | | | | |
|---|---|---|---|---|
| 5,172,098 | A * | 12/1992 | Leyden | G08B 13/1454 340/568.2 |
| 5,726,627 | A * | 3/1998 | Kane | G08B 13/1454 340/3.31 |
| 6,104,289 | A * | 8/2000 | Rand | G08B 13/1454 340/568.1 |
| 6,537,109 | B1 * | 3/2003 | Emery | H01R 9/2433 340/4.36 |
| 7,094,073 | B2 * | 8/2006 | Obata | H01R 13/514 439/507 |
| 7,148,796 | B2 * | 12/2006 | Joy | G01K 13/00 340/5.52 |
| 7,209,038 | B1 * | 4/2007 | Deconinck | G08B 13/1409 340/541 |
| 2006/0015205 | A1 * | 1/2006 | Murray | G06Q 10/087 700/108 |
| 2008/0318467 | A1 * | 12/2008 | Denomme | H01R 31/08 439/511 |

* cited by examiner

*Primary Examiner* — Jared Fureman
*Assistant Examiner* — Emmanuel R Dominique
(74) *Attorney, Agent, or Firm* — Boyle Fredrickson, S.C.

(57) ABSTRACT

In distribution networks for safety sensors and devices, aspects of the invention provide routing individualized status signals in parallel to potential safety sensor locations in addition to serially routing safety signals to provide substantially increased protection. A shorting plug that electrically shorts together an individualized status signal to a voltage reference level at a safety sensor location, in addition to electrically shorting together the safety signals for electrical continuity, provides individualized status information for each potential safety sensor location in addition to the serial safety information provided by the safety signals. Another aspect of the invention provides a remote monitoring device coupled to one or more adapter ports, with each adapter port coupled to one or more safety sensors, wherein adapter ports are coupled via cabling with cable endings of the same type, thereby preventing circumvention of a safety sensor simply by coupling together adjacent cables.

18 Claims, 6 Drawing Sheets

DISTRIBUTION NETWORKS FOR SAFETY SENSORS AND DEVICES

BACKGROUND OF THE INVENTION

The present invention relates to safety applications in industrial environments, and in particular, to distribution networks for safety sensors and devices.

Industrial environments typically include numerous mechanical operations, such as doors opening and closing, conveyor systems moving, and so forth. Such mechanical operations may be hazardous if the state is not known or fully appreciated. For example, if a door in the industrial environment is propped open, such as for inspection or diagnostics of machinery, and a conveyor system moves, or if a door in the industrial environment is closed, such as at a receiving station, and the conveyor system moves, a catastrophic condition could potentially result, such as human injury and/or property damage.

Safety sensors and safety distributions systems are known techniques for increasing the protection of personnel and equipment in such environments. Safety sensors may monitor, among other things, the status of doors and the motion of equipment. Safety sensors may comprise, for example, various modules with integrated proximity sensors, connectors or other mechanisms for detection, and switches for electrical signaling. Safety sensors are typically dispersed throughout the industrial environment and often attach to a one or more centralized safety distribution boxes as part of a safety sensor distribution network.

In operation, a safety signal may be routed to each particular safety sensor and back, such that if electrical continuity of the safety signal is detected, a safe condition is believed to be likely. On the other hand, if electrical continuity of the safety signal is not detected, such as the safety sensor breaking electrical continuity due to detection of an open door that should be closed, an unsafe condition may be presumed, an alert may be triggered, and the related industrial process may be stopped.

For additional safety, redundant signals may also be routed to each particular safety sensor and back, such that if electrical continuity is lost among any one of the safety signals, an unsafe condition may again be presumed. In addition, the safety signals are often routed serially through each safety sensor via the safety distribution box, such that if electrical continuity is lost due to any one of the safety sensors, an unsafe condition may again be presumed.

The safety distribution box often, in turn, couples to a power supply, a dedicated safety relay or safety programmable logic controller ("PLC") and/or a general PLC. PLC's typically include a processor executing software stored in memory and numerous input and output connections for interacting with the industrial environment, including for monitoring safety signals and triggering an alert upon detecting an unsafe condition.

Shorting plugs that electrically short together safety signals are also typically used in such environments for maintaining flexibility. If, for example, a safety sensor is no longer needed, the safety sensor may be removed and a shorting plug may be installed in the old safety sensor's place at the safety distribution box. As such, electrical continuity of the safety signals may be maintained.

However, bypassing safety sensors that are still in use in the industrial environment with shorting plugs results in a loss of safety monitoring in the system. As a result, the potential for catastrophic conditions occurring increases.

SUMMARY OF THE INVENTION

The present inventors have recognized that individualized status signals routed in parallel to each of the potential safety sensor locations provides substantially increased protection. A shorting plug that electrically shorts together an individualized status signal to a voltage reference level at a safety sensor location, in addition to electrically shorting together the safety signals for electrical continuity as described above, provides individualized status information for each potential safety sensor location in addition to the serial safety information provided by the safety signals.

A PLC may implement logic, such as by executing computer software, to monitor the individualized status signals in addition to monitoring the safety signals. A table, which may be stored and periodically updated in the PLC, may indicate the presence or absence of safety sensors for each potential location. If electrical continuity in one or more safety signals are broken, such as by a safety sensor indicating an unsafe condition, or if an individualized status signal indicates the absence of a safety sensor and the corresponding table indicates that a safety sensor should be present, the PLC may trigger an alert, which may result in stopping one or more industrial processes, lighting a warning light, sounding an alarm and/or sending an electronic mail or SMS text message.

The shorting plug may electrically short together a status signal to a positive DC voltage reference level, such as +24 Volts DC, though in other embodiments, other voltage references or ground could be used. Installing the shorting plug may also illuminate a light emitting diode ("LED") as a result of the electrical shorting which may be visually inspected. The LED may be located on the distribution box, or in an alternative embodiment, on the shorting plug itself. The shorting plug may also have preferred colors, such as red, and/or a preferred connector styles for ensuring its use in the safety system.

As such, in accordance with embodiments of the present invention, installation of shorting plugs in the place of safety sensors can be readily recognized and detected, thereby allowing verification of such uses, and possibly corrective actions.

Another aspect of the present invention provides a remote monitoring device, such as a PLC, coupled to one or more adapter ports, with each adapter port coupled to one or more safety sensors, wherein adapter ports are coupled via cabling with cable endings of the same type, such as female-to-female cable ends, or male-to-male cable ends. As such, an adapter port, and in turn, a safety sensor, may not be circumvented simply by coupling together adjacent cables.

These and other objects, advantages and aspects of the invention will become apparent from the following description. The particular objects and advantages described herein may apply to only some embodiments falling within the claims and thus do not define the scope of the invention. In the description, reference is made to the accompanying drawings which form a part hereof, and in which there is shown a preferred embodiment of the invention. Such embodiment does not necessarily represent the full scope of the invention and reference is made, therefore, to the claims herein for interpreting the scope of the invention.

BRIEF DESCRIPTION OF THE DRAWINGS

Embodiments of the invention will now be described, by way of example only, with reference to the accompanying drawings, in which.

DETAILED DESCRIPTION OF THE PREFERRED EMBODIMENT

Figure 1:
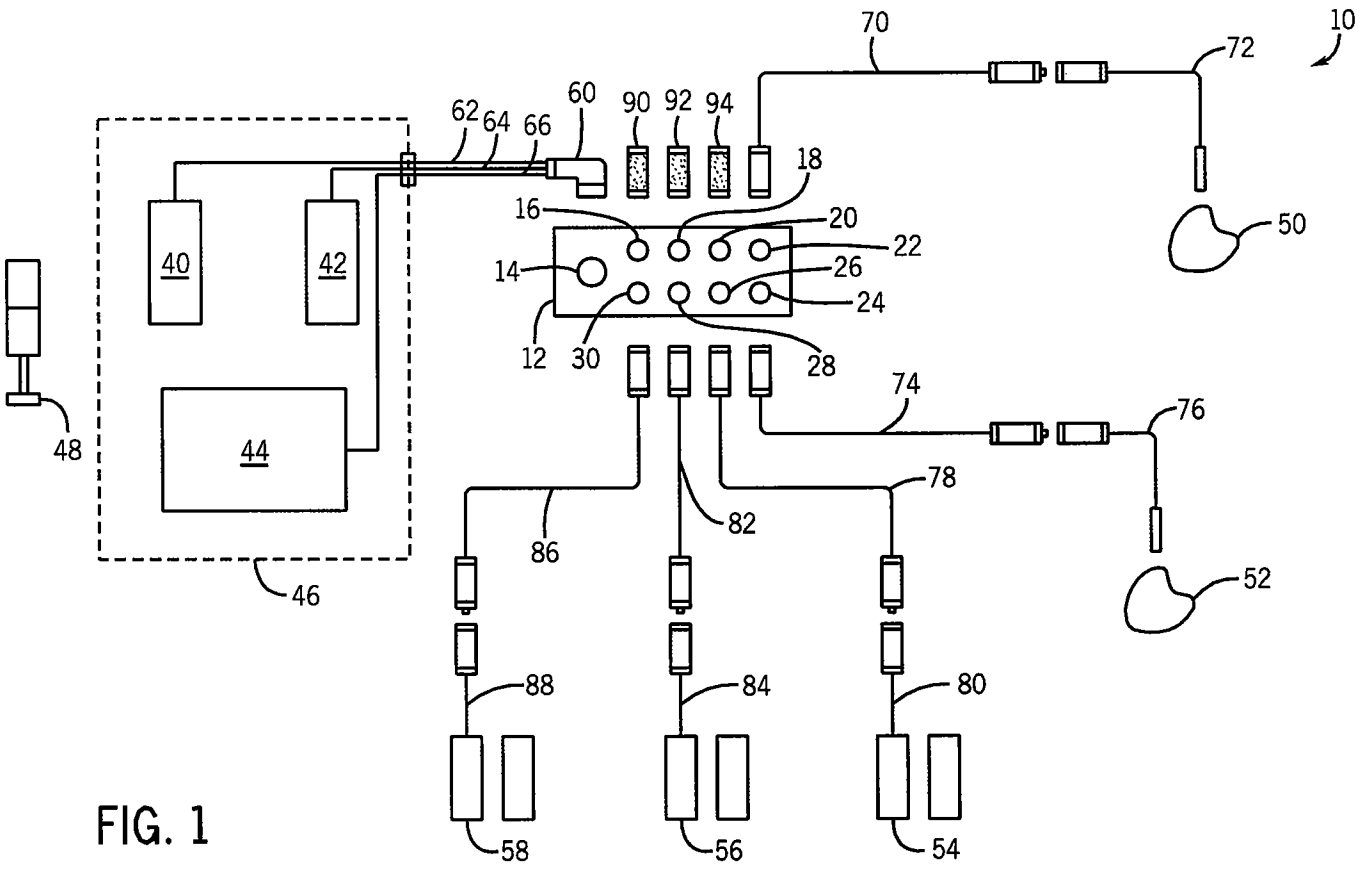
FIG. 1 is a logical drawing of a distribution box, shorting plugs, safety sensors and remote devices in accordance with an embodiment of the present invention.

Referring now to FIG. 1, various aspects of an embodiment of the present invention will now be described in the context of a safety distribution system 10. The safety distribution system 10 may comprise a distribution box 12 with a primary electrical connector half 14 and a plurality of secondary electrical connector halves 16, 18, 20, 22, 24, 26, 28 and 30.

The primary electrical connector half 14 may be used for communicating with one or more remote devices, including a power supply 40, a dedicated safety relay or safety PLC 42 and/or a general PLC 44. The power supply 40, the safety PLC 42 and/or the general PLC 44 may be located together in a single enclosure 46 and may be in proximity to a warning light tower 48 or other alarm indicating device. The safety PLC 42 and the general PLC 44 may each include a processor executing software for monitoring the safety sensors, and in alternative embodiments, the functionality may be combined into a single PLC or other capable device.

The primary electrical connector half 14 may extend from the housing of the distribution box 12 for coupling to and communicating with one or more remote devices via a primary electrical cable 60 having an opposing electrical connector half. The primary electrical cable 60 may route signals of different varieties, including power signal conductors 62, which provides a positive DC voltage reference level via +24V DC signal and a ground via Common signal, pairs of input and output safety signal conductors 64, which may provide redundant serially connected safety signals throughout the safety system, and individualized status signal conductors 66, which may provide an individual status signal for each potential safety sensor location. Within the single enclosure 46, the power signal conductors 62 may couple to the power supply 40, the safety signal conductors 64 may couple to the safety PLC 42, and the status signal conductors 66 may couple to the general PLC 44. Alternative embodiments, however, may provide more or fewer signals and in alternative arrangements, such as single PLC for safety and status signals, or a power supply local to or integrated within the distribution box 12.

The secondary electrical connector halves 16, 18, 20, 22, 24, 26, 28 and 30 each are used to communicate with one or more safety sensors of various configurations and types, and in this example, safety sensors 50, 52, 54, 56 and 58. Safety sensors may include, for example, safety switches for detecting the change in position of objects and/or machinery, such as the SensaGuard™ system available from Rockwell Automation, Inc. of Milwaukee, Wis. Intermediate cables, such as cables 70 and 72, cables 78 and 80, cables 82 and 84, and cables 86 and 88, may be used for coupling the distribution box 12 to the safety sensors, such as safety sensors 50, 52, 54, 56, and 58, respectively, as the safety sensors may be widely dispersed throughout the industrial environment. Safety sensors 50, 52, 54, 56 and 58 have two jointly acting electrical switches controlled by a sensed condition, with one switch across a different input and output pair.

Through the primary electrical connector half 14, the safety signal conductors 64 redundantly join the secondary electrical connector halves 16, 18, 20, 22, 24, 26, 28 and 30, and safety sensors coupled thereto, in series from first to last, such that safety signal outputs of each secondary electrical connector half are coupled to safety signal inputs of a next secondary electrical connector half until reaching the last secondary electrical connector half. In this way, the safety signal conductors 64 couple serially from the safety PLC 42 to the primary electrical connector half 14, via the primary electrical cable 60, then to the first secondary electrical connector half 16, then to any safety sensor attached to the first secondary electrical connector half 16, then back out of the first secondary electrical connector half 16, then to the next secondary electrical connector half 18, and so forth. At the last secondary electrical connector half 30, the safety signal conductors 64 continue to couple serially to the primary electrical connector half 14, then back to the safety PLC 42 via the primary electrical cable 60.

The safety PLC 42 may monitor electrical continuity of the safety signals 64. If electrical continuity is lost on any of the serially connected safety signals 64, such as by removal a safety sensor from a connector half, or by a safety sensor triggering an unsafe condition, or by faulty operation of a single safety signal, the safety PLC 42 detects the condition and responds accordingly by triggering an alert, such as illuminating a red light at the light tower 48, sounding an alarm, and/or sending an electronic mail or SMS text message, and putting the system and/or machine into a safe state, such as stopping one or more industrial processes or machines.

If a safety sensor is not to be attached at a secondary electrical connector half, a shorting plug may be used in its place to maintain electrical continuity. For example, in the safety distribution system 10, the safety signal conductors 64 couple serially from the safety PLC 42 to the primary electrical connector half 14, via the primary electrical cable 60, then to the first secondary electrical connector half 16, then through a shorting plug 90 attached, which maintains serial electrical continuity across the first secondary electrical connector half 16, then to the next secondary electrical connector half 18, and so forth. The shorting plug 90 may have unique characteristics for distinguishing it from other types of shorting plugs and connectors, such as unique shapes, colors and/or markings.

In addition to safety signal conductors 64, the safety distribution system 10 and the distribution box 12 also utilizes the status signal conductors 66. The status signal conductors 66 provide an individualized status signal conductor to each potential safety sensor location via each secondary electrical connector half. The status signal conductors 66 may default to a particular condition when monitored, such as ground or floating high impedance, and upon insertion of a shorting plug at particular secondary electrical connector half, the corresponding status signal may be driven to a different condition, such as a DC voltage level, via electrical shorting by the shorting plug. This may allow, for example, detection of a shorting plug where a safety sensor is expected, thereby triggering an alert and putting the system and/or machine into a safe state.

In the safety distribution system 10, the status signal conductors 66 couple individually, in parallel, from the general PLC 44 to the primary electrical connector half 14 via the primary electrical cable 60. Then, a first status signal of the status signal conductors 66 couples to the first secondary electrical connector half 16, a second status of the status signal conductors 66 couples to the next secondary electrical connector half 18, and so forth, until each potential safety sensor location is coupled to a status signal. If a safety sensor is attached at a secondary electrical connector half, the respective status signal may simply default to the first condition, such as grounding or floating. However, if a shorting plug is attached to the secondary electrical connector half, the respective status signal may then be driven to the second condition, such as the DC voltage reference level, via the shorting plug.

In an alternative embodiment, safety signal conductors 64 and status signal conductors 66 may both be monitored by the safety PLC 42, or may both be monitored by the general PLC 44 or by another device.

Figure 2:
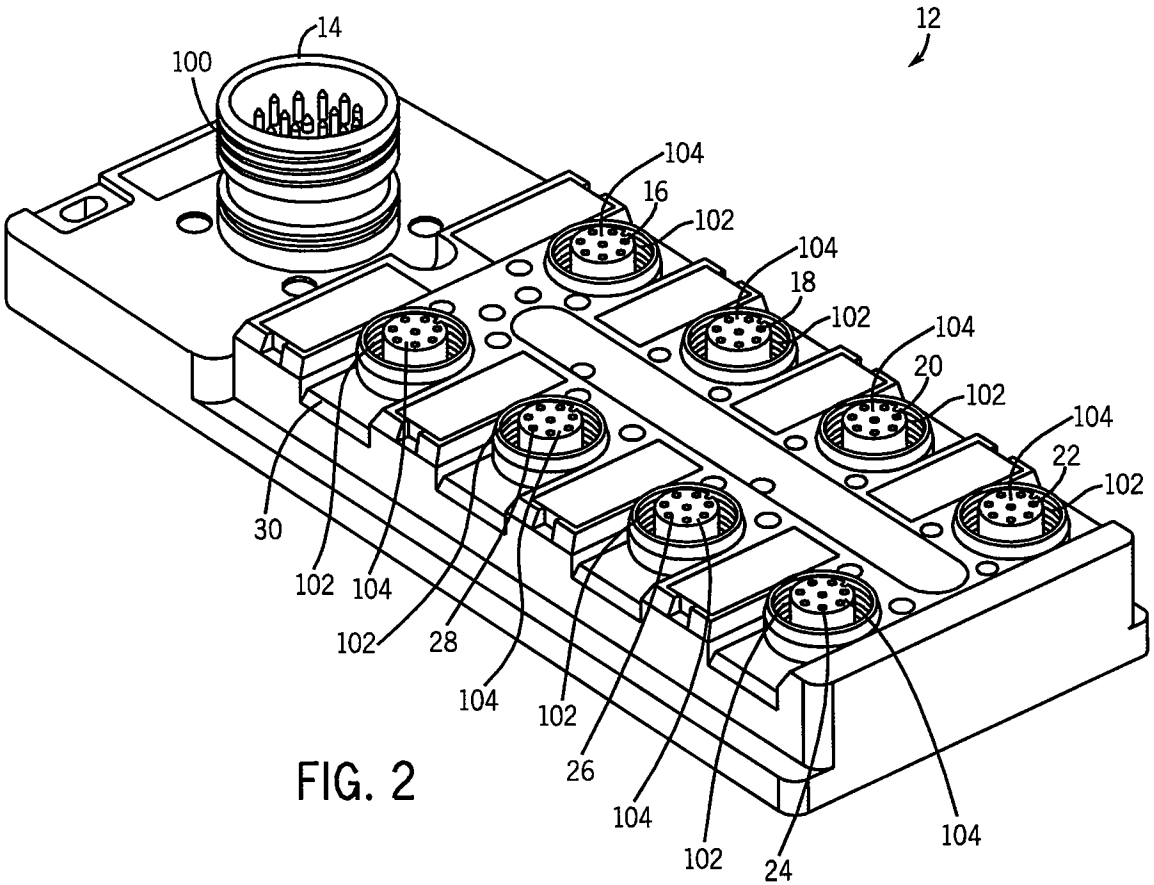
FIG. 2 is an isometric view of a distribution box in accordance with an embodiment of the present invention.

Referring now to FIG. 2, an isometric view of the distribution box 12 in accordance with an embodiment of the present invention is shown. The distribution box 12 may have varying standard and/or non-standard shapes, such as appearing long and rectangular with beveled edges, contours, mounting shapes and/or holes adequate for mechanically and functionally integrating into the industrial environment.

The primary electrical connector half 14 may be round with exterior circumferential threading 100 to allow an opposing electrical connector half, such as the connector on the primary electrical cable 60, to attach. The primary electrical connector half 14 also includes a plurality of pins 102, for example, nineteen pins here, for coupling the power signal conductors 62, the pairs of input and output safety signal conductors 64 and the individualized status signal conductors 66, and possibly others, to the power supply 40, the safety PLC 42 and/or the general PLC 44.

The secondary electrical connector halves 16, 18, 20, 22, 24, 26, 28 and 30 may be round in shape with interior circumferential threading 102 to allow an opposing electrical connector half, such as a connector and cable leading to a safety sensor, or a connector on a shorting plug, to attach. The secondary electrical connector halves 16, 18, 20, 22, 24, 26, 28 and 30 also each include a receiving block 104 for receiving the power signal conductors 62, the safety signal conductors 64 and a particular status signal of the status signal conductors 66 and routing to the safety sensor or shorting plug.

In alternative embodiments, other connector shapes, sizes, configurations and/or styles for the primary electrical connector half 14 and/or the secondary electrical connectors halves 16, 18, 20, 22, 24, 26, 28 and 30 may be used.

The distribution box 12 may also include labels 106 in proximity to the primary electrical connector half 14 and the secondary electrical connector halves 16, 18, 20, 22, 24, 26, 28 and 30. The labels 106 may be manually updated with text or symbols for increased safety in the industrial environment, such as indicating no safety sensor in a particular position, and hence a shorting plug is expected, or a safety sensor in a particular position, and hence a safety sensor (and not shorting plug) is expected.

The distribution box 12 may also include a plurality of light emitting diodes ("LED's") (not shown), including, for example, a power LED which may be green when lit for indicating the distribution box 12 is receiving power, and a plurality of status LED's which may be amber when lit for indicating if a particular status signal is being driven to the second condition by a shorting plug as described above with respect to FIG. 1. Each LED may be visually inspected and compared to the industrial environment and operating software for increased safety.

Figure 3:
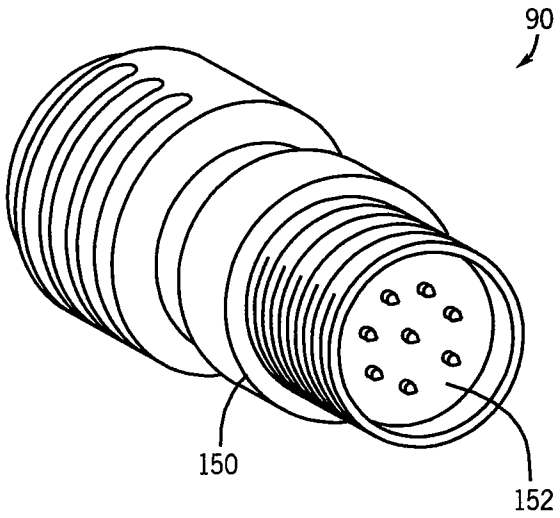
FIG. 3 is an isometric view of a shorting plug in accordance with an embodiment of the present invention.

Referring now to FIG. 3, an isometric view of the shorting plug 90 in accordance with an embodiment of the present invention is shown. The shorting plug 90 may be generally cylindrical in shape, though other standard and/or non-standard shapes may apply, including beveled edges and ergonomic contours. The electrical connecting end of the shorting plug 90 may be round with exterior circumferential threading 150 to allow attachment to one of the secondary electrical connector halves 16, 18, 20, 22, 24, 26, 28 and 30. The shorting plug 90 also includes a plurality of pins 152, for example, eight pins here, for coupling with the receiving block 104 of one of the secondary electrical connector halves 16, 18, 20, 22, 24, 26, 28 and 30.

In an alternative embodiment, the shorting plug 90 may also include an LED that may be lit when attached to a secondary electrical connector half for indicating that the particular status signal is being driven to the second condition as described above with respect to FIG. 1. The LED may be visually inspected and compared to the industrial environment and operating software for increased safety. The shorting plug may also have a preferred color, such as red, and/or a preferred connector style, for ensuring its use in the system.

Figure 4:
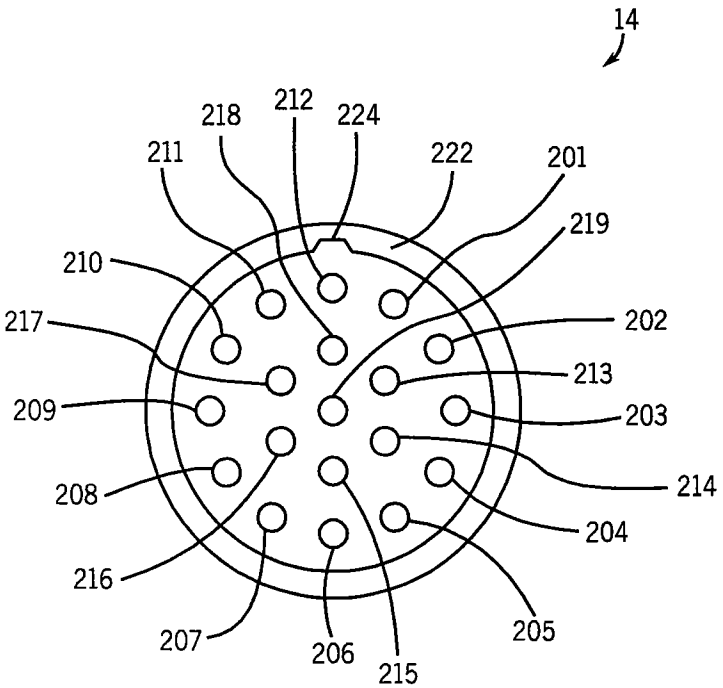
FIG. 4 is a logical pin out drawing for a primary electrical connector for use with a distribution box in communicating with one or more remote devices in accordance with an embodiment of the present invention.

Referring now to FIG. 4 and to Table 1 below, a logical pin out drawing and related description for the primary electrical connector half 14 is shown in accordance with an embodiment of the present invention. The example primary electrical connector half 14 here has nineteen connector pins 201-219, with certain connector pins being no-connects and/or reserved for future use, an electrical shrouding 222 and a notch 224 for facilitating a keyed insertion. Table 1 also includes wiring colors for distinguishing each conductor signal in use.

TABLE 1

| Connector Pin | Description | Wiring Color |
|---|---|---|
| 201 | — | — |
| 202 | Safety A+ (OSSD) | Red |
| 203 | Safety B (OSSD) | Grey |
| 204 | Aux J2 | Red/Blue |
| 205 | — | — |
| 206 | Common | Blue |
| 207 | Aux J1 | Grey/Pink |
| 208 | Aux J3 | White/Green |
| 209 | Aux J5 | White/Yellow |
| 210 | Aux J7 | White/Grey |
| 211 | Lock Command | Black |
| 212 | Ground | Green/Yellow |
| 213 | Aux J6 | Yellow/Brown |
| 214 | Aux J4 | Brown/Green |
| 215 | — | — |
| 216 | Safety B+ (OSSD) | Yellow |
| 217 | Safety A (OSSD) | Pink |

TABLE 1-continued

| Connector Pin | Description | Wiring Color |
|---|---|---|
| 218 | Aux J8 | Grey/Brown |
| 219 | +24 V DC | Brown |

The power signal conductors 62 may include the Common signal at connector pin 206, the Ground signal at connector pin 212, and the +24V DC signal at connector pin 219.

The safety signal conductors 64 may include an input Safety A+(output signal switching device ("OSSD")) signal at connector pin 202, serially routed through the safety sensors (or shorting plugs) via the distribution box 12, with a corresponding output Safety A (OSSD) signal at connector pin 217, and another input Safety B+(OSSD) signal at connector pin 216, also serially routed through safety sensors (or shorting plugs) via the distribution box 12, with another corresponding output Safety B (OSSD) signal at connector pin 203. If a loss of electrical continuity is detected in either serially routed path, the system may trigger an alert and put the system and/or machine into a safe state accordingly.

The status signal conductors may include the Aux J1 signal at connector pin 207, the Aux J2 signal at connector pin 204, the Aux J3 signal at connector pin 208, the Aux J4 signal at connector pin 214, the Aux J5 signal at connector pin 209, the Aux J6 signal at connector pin 213, the Aux J7 signal at connector pin 210 and the Aux J8 signal at connector pin 218. If, for example, the distribution box 12 has only four secondary electrical connector halves, then only four status signal conductors, such as Aux J144, may be used. However, if, for example, the distribution box 12 has eight secondary electrical connector halves, then all eight status signal conductors, Aux J1-J8, would be used. Alternative embodiments may provide additional conductor signals, connector pins and/or arrangements for further variations.

The Lock Command signal at connector pin 211 may be used by the safety PLC 42, the general PLC 44 and/or any other remote device for locking the configuration. The connector pins 201, 205 and 215 in this embodiment are reserved for future use.

Figure 5:
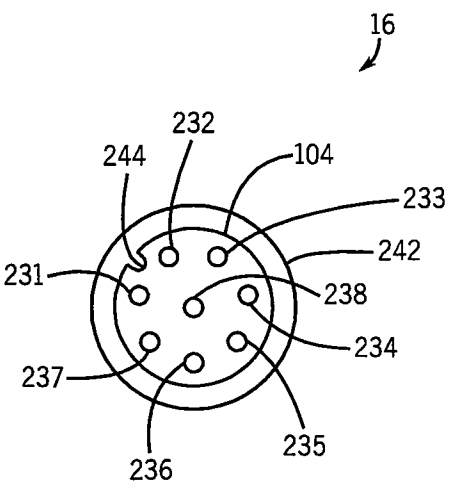
FIG. 5 is a logical pin out drawing for a secondary electrical connector for use with a distribution box in communicating with a safety sensor, which may also receive a shorting plug, in accordance with an embodiment of the present invention.

Referring now to FIG. 5 and to Table 2 below, a logical pin out drawing and related description for the secondary electrical connector half 16 is shown in accordance with an embodiment of the present invention. The exemplar secondary electrical connector half 14 here has eight connector pins 231-238, an electrical shrouding 242 and a notch 244 for facilitating a keyed insertion.

TABLE 2

| Connector Pin | Description |
|---|---|
| 231 | Aux |
| 232 | +24 V DC |
| 233 | Lock Command |
| 234 | Safety B+ (OSSD) |
| 235 | Safety A (OSSD) |
| 236 | Safety B (OSSD) |
| 237 | Common |
| 238 | Safety A+ (OSSD) |

The power signal conductors 62 may include coupling of the +24V DC signal at connector pin 232 and the Common signal at connector pin 237, of the secondary electrical connector half 16, from corresponding signals of the primary electrical connector half 14. The safety signal conductors 64 may include coupling the input Safety A+(OSSD) signal at connector pin 238, the output Safety A (OSSD) signal at connector pin 235, the input Safety B+(OSSD) signal at connector pin 234 and the output Safety B (OSSD) signal at connector pin 236, of the secondary electrical connector half 16, from corresponding signals of the primary electrical connector half 14. The status signal conductors 66 may include coupling the Aux signal at connector pin 231 of the secondary electrical connector half 16 from a particular one of the status signal conductors 66 from the primary electrical connector half 14. A Lock Command signal may also be coupled to connector pin 233 of the secondary electrical connector half 16 from a corresponding signal of the primary electrical connector half 14.

Figure 6:
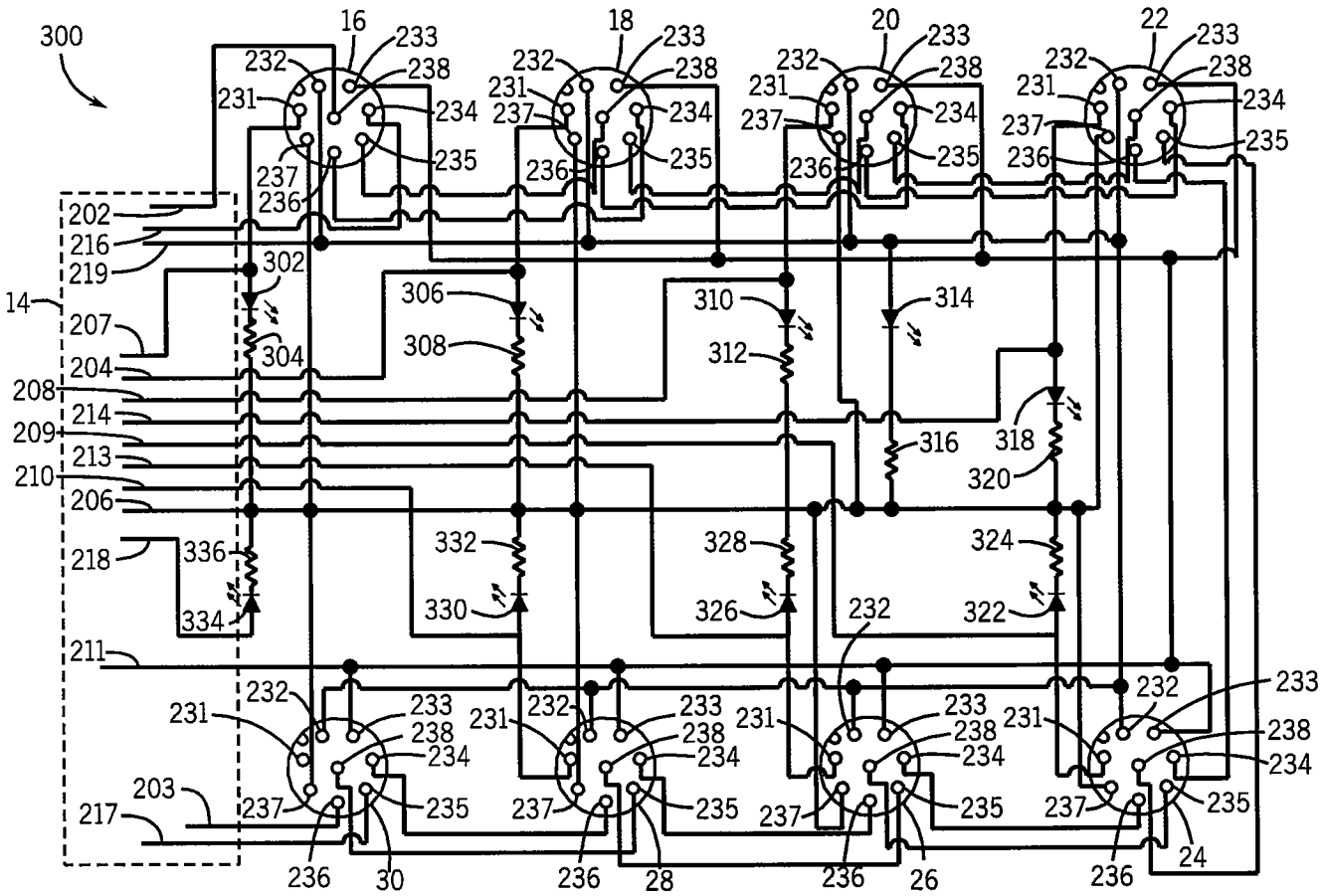
FIG. 6 is a schematic diagram of circuitry for a distribution box which may accommodate, for example, eight potential safety sensors, shorting plugs or combinations thereof, in accordance with an embodiment of the present invention.

Referring now to FIG. 6, circuitry 300 for the distribution box 12, which may accommodate, for example, eight potential safety sensors, shorting plugs or combinations thereof, is shown in accordance with an embodiment of the present invention. As described above with respect to FIGS. 1, 4 and 5, the power signal conductors 62 may comprise coupling of the +24V DC signal at connector pin 219 of the primary electrical connector half 14 to connector pin 232 at each of the secondary electrical connector halves 16, 18, 20, 22, 24, 26, 28 and 30, and coupling the Common signal at connector pin 206 of the primary electrical connector half 214 to connector pin 237 at each of the secondary electrical connector halves 16, 18, 20, 22, 24, 26, 28 and 30. The circuitry 300 may also include an LED 314 in series with a resistor 316, coupled between the +24V DC signal and the Common signal, wherein the LED 314 illuminates upon receiving power.

The safety signal conductors 64 may comprise coupling the input Safety A+(OSSD) signal at connector pin 202 of the primary electrical connector half 14 to the input Safety A+(OSSD) signal at connector pin 238 of the first secondary electrical connector half 16. Next, a safety sensor or shorting plug (not shown) allows coupling the input Safety A+(OSSD) signal at connector pin 238 of the first secondary electrical connector half 16 to the output Safety A (OSSD) signal at connector pin 235 of the first secondary electrical connector half 16. Next, the output Safety A (OSSD) signal at connector pin 235 of the first secondary electrical connector half 16 couples to the input Safety A+(OSSD) signal at connector pin 238 of the next secondary electrical connector half 18. Another safety sensor or shorting plug (not shown) then allows coupling the input Safety A+(OSSD) signal at connector pin 238 of the secondary electrical connector half 18 to the output Safety A (OSSD) signal at connector pin 235 of the secondary electrical connector half 18. Next, the output Safety A (OSSD) signal at connector pin 235 of the secondary electrical connector half 18 couples to the input Safety A+(OSSD) signal at connector pin 238 of the next secondary electrical connector half 20. This serial coupling continues from secondary electrical connector half to next secondary electrical connector half until reaching the last secondary electrical connector half 30. At the last secondary electrical connector half 30, the output Safety A (OSSD) signal at connector pin 235 couples to the output Safety A (OSSD) signal at connector pin 217 of the primary electrical connector half 14.

In a similar, redundant fashion, the input Safety B+(OSSD) signal at connector pin 216 of the primary electrical connector half 14 couples to the input Safety B+(OSSD) signal at connector pin 234 of the first secondary electrical connector half 16. Again, the safety sensor or shorting plug (not shown) allows coupling the input Safety B+(OSSD) signal at connector pin 234 of the first secondary electrical connector half 16 to the output Safety B (OSSD) signal at connector pin 236 of the first secondary electrical connector half 16. Next, the output Safety B (OSSD) signal at connector pin 236 of the first secondary electrical connector half 16 couples to the input Safety B+ (OSSD) signal at connector pin 234 of the next secondary electrical connector half 18. Another safety sensor or shorting plug (not shown) then allows coupling the input Safety B+(OSSD) signal at connector pin 234 of the secondary electrical connector half 18 to the output Safety B (OSSD) signal at connector pin 236 of the secondary electrical connector half 18. Next, the output Safety B (OSSD) signal at connector pin 236 of the secondary electrical connector half 18 couples to the input Safety B+(OSSD) signal at connector pin 234 of the next secondary electrical connector half 20. This serial coupling also continues from secondary electrical connector half to next secondary electrical connector half until reaching the last secondary electrical connector half 30. At the last secondary electrical connector half 30, the output Safety B (OSSD) signal at connector pin 236 couples to the output Safety B (OSSD) signal at connector pin 203 of the primary electrical connector half 14.

The status signal conductors 66 may comprise individually coupling the Aux J1-J8 status signals from the primary electrical connector half 14 to each of the respective secondary electrical connector halves 16, 18, 20, 22, 24, 26, 28 and 30. For example, the Aux J1 signal at connector pin 207 of the primary electrical connector half 14 individually couples to the Aux signal at connector pin 231 of the secondary electrical connector half 16; the Aux J2 signal at connector pin 204 of the primary electrical connector half 14 individually couples to the Aux signal at connector pin 231 of the next secondary electrical connector half 18; and so forth.

If a shorting plug (not shown) is attached to one of the secondary electrical connector halves 16, 18, 20, 22, 24, 26, 28 and 30, the shorting plug couples together the Aux signal at connector pin 231 of that secondary electrical connector half to the +24V DC signal at connector pin 232 of that secondary electrical connector half. As such, a remote device monitoring the status signal conductors 66, such as the general PLC 44, may detect the +24V DC signal, which may be accordingly interpreted by the remote device as a shorting plug present at that secondary electrical connector half. The remote device may then execute software to read a table from memory which indicates the expected presence or absence of safety sensors for each secondary electrical connector half associated with a status signal, and then trigger an alert and/or put the system and/or machine into a safe state if the table indicates that a shorting plug should be present.

If, on the other hand, a safety sensor (not shown) is attached to the secondary electrical connector half, the safety sensor does not couple the Aux signal at connector pin 231 of the secondary electrical connector half to the +24V DC signal at connector pin 232 of the secondary electrical connector half. As such, the remote device may interpret the status signal in its default condition as indicating no shorting plug is present at that secondary electrical connector half Once again, the remote device may execute software to read the table from memory which indicates the expected presence or absence of safety sensors for each secondary electrical connector half associated with a status signal, and in this case, trigger an alert and/or put the system and/or machine into a safe state if the table indicates that a shorting plug should be present.

Each of the status signal conductors 66 may also couple to an LED that illuminates upon a shorting plug coupling together the Aux signal at connector pin 231 of a secondary electrical connector half to the +24V DC signal at connector pin 232 of the secondary electrical connector half. For example, the Aux signal at connector pin 231 of the secondary electrical connector half 16 may also couple to an LED 302 in series with a resistor 304 to the Common signal at connector pin 237 of the secondary electrical connector half 16; the Aux signal at connector pin 231 of the secondary electrical connector half 18 may also couple to an LED 306 in series with a resistor 308 to the Common signal at connector pin 237 of the secondary electrical connector half 18; and so forth.

The Lock Command signal at connector pin 211 of the primary electrical connector half 14 also couples to the Lock Command signal at connector pin 233 for each of the respective secondary electrical connector halves 16, 18, 20, 22, 24, 26, 28 and 30.

Figure 7:
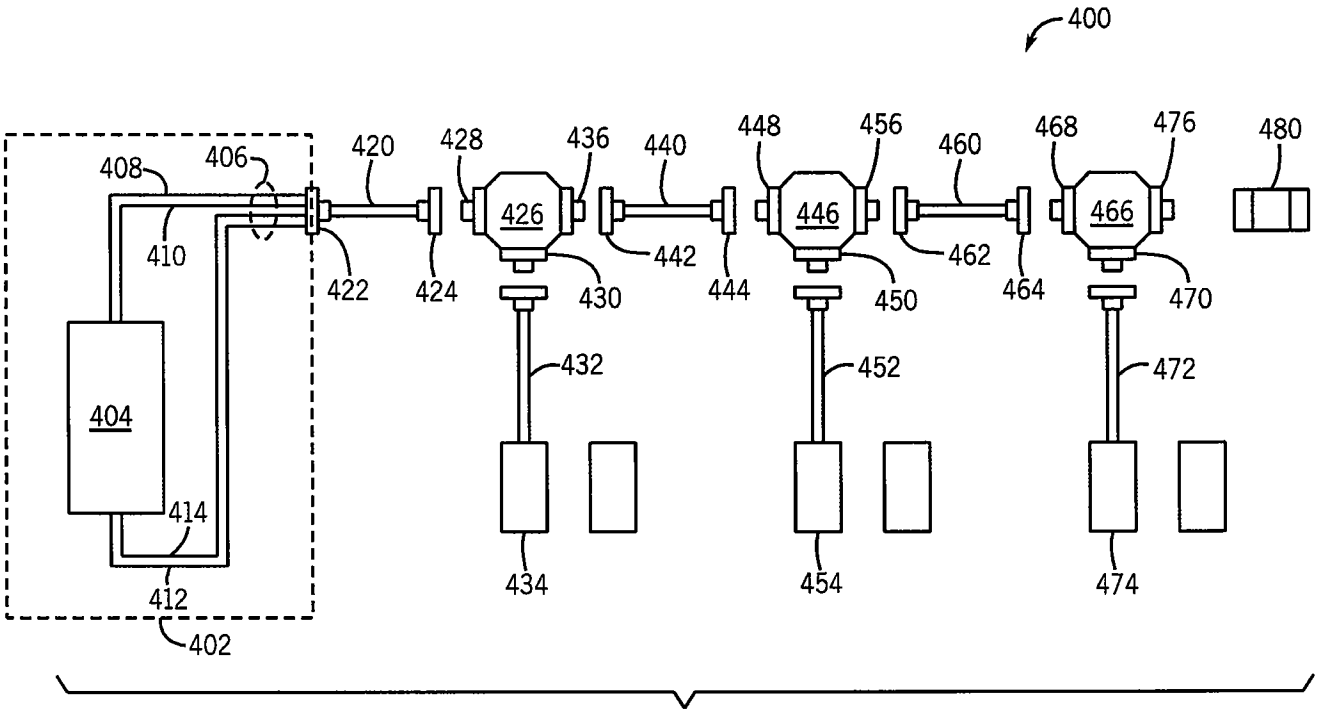
FIG. 7 is a logical drawing of a safety distribution system using a remote device, adapter ports, safety sensors and cabling with cable endings of the same type in accordance with an embodiment of the present invention.

Referring now to FIG. 7, a safety distribution system 400 is shown. The safety distribution system 400 may comprise an enclosure 402 in proximity to a warning light tower, or other alarm indicating device, and may contain a remote monitoring device 404, such as a safety PLC. A group of safety signal conductors 406, which may include a Safety A+(OSSD) signal 408, a Safety B+(OSSD) signal 410, a Safety A (OSSD) signal 412 and a Safety B (OSSD) signal 414, as described with respect to FIGS. 1 and 4-6 above, are coupled to the device 404 for monitoring electrical continuity of the safety signal conductors 406, which provide redundant loop back paths through safety sensors in the system.

The safety signal conductors 406 are coupled to a first electrical cable 420 having cable endings 422 and 424 of the same type, such as female cable end 422 and female cable end 424. The first electrical cable 420, in turn, couples to a first adapter port 426 via a first connector half 428 of the opposite type as the cable end 424. The first adapter port 426, in turn, couples the safety signal conductors 406, via a second connector half 430, to a safety sensor cable 432 and safety sensor 434. The first adapter port 426 receives the safety signal conductors 406 back from the safety sensor cable 434 via the safety sensor cable 432, and, in turn, couples the safety signal conductors 406 to a third connector half 436.

A second electrical cable 440 having cable endings 442 and 444 of the same type, and similar to the first electrical cable 420 and cable endings 422 and 424, couples between the first adapter port 426, via the third connector half 436, and a second adapter port 446, via a first connector half 448 on the second adapter port 446 of the opposite type as the cable end 444. Similar to as described above, the second adapter port 448, in turn, couples the safety signal conductors 406, via a second connector half 450, to a safety sensor cable 452 and safety sensor 454. The second adapter port 446 receives the safety signal conductors 406 back from the safety sensor cable 454 via the safety sensor cable 452, and in turn, couples the safety signal conductors 406 to a third connector half 456. This coupling may repeat multiple times via multiple cables and adapter ports until reaching a last adapter port 466. At the last adapter port 466, a shorting plug 480 may be coupled to a third connector half 476 of the last adapter port 476 to loop back the safety signal conductors 406 through each cable and adapter port to the device 404. The device 404 may then monitor the safety signal conductors 406 for electrical continuity, and may trigger an alert and/or put the system and/or machine into a safe state if electrical continuity on any of the safety signal conductors 406 is lost.

Accordingly, the safety sensor 434 may not be bypassed simply by coupling the first electrical cable 420 to the second electrical cable 440 as the cable ends 424 and 442 are of the same type. Similarly, the safety sensor 454 may not be bypassed simply by coupling the second electrical cable 440 to the third electrical cable 460 as the cable ends 444 and 462 are of the same type. Also, the safety sensor 474 may not be bypassed simply by coupling the third electrical cable 460 to the shorting plug 480 as the cable end 464 and the connector half on the shorting plug 480 are of the same type.

In an alternative embodiment, male cable endings of the same type may be used. In addition, in alternative embodiments, another safety sensor instead of a shorting plug may be used, or one or more adapter port having differing numbers of connector halves, and subsequently attached safety sensors and/or shorting plugs, may also be used.

One or more specific embodiments of the present invention have been described above. It is specifically intended that the present invention not be limited to the embodiments and/or illustrations contained herein, but include modified forms of those embodiments including portions of the embodiments and combinations of elements of different embodiments as come within the scope of the following claims. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Nothing in this application is considered critical or essential to the present invention unless explicitly indicated as being "critical" or "essential."

Certain terminology is used herein for purposes of reference only, and thus is not intended to be limiting. For example, terms such as "upper," "lower," "above," and "below" refer to directions in the drawings to which reference is made. Terms such as "front," "back," "rear," "bottom," "side," "left" and "right" describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first," "second" and other such numerical terms referring to structures do not imply a sequence or order unless clearly indicated by the context.

When introducing elements or features of the present disclosure and the exemplary embodiments, the articles "a," "an," "the" and "said" are intended to mean that there are one or more of such elements or features. The terms "comprising," "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

References to "a microprocessor" and "a processor" or "the microprocessor" and "the processor" can be understood to include one or more microprocessors that can communicate in a stand-alone and/or a distributed environment(s), and can thus be configured to communicate via wired or wireless communications with other processors, where such one or more processor can be configured to operate on one or more processor-controlled devices that can be similar or different devices. Furthermore, references to memory, unless otherwise specified, can include one or more processor-readable and accessible memory elements and/or components that can be internal to the processor-controlled device, external to the processor-controlled device, and can be accessed via a wired or wireless network.

The present invention may be part of a "safety system" used to protect human life and limb in a field, warehouse, factory or industrial environment. Nevertheless, the term "safety," "safely" or "safe" as used herein is not a representation that the present invention will make the environment safe or that other systems will produce unsafe operation. Safety in an industrial process depends on a wide variety of factors outside of the scope of the present invention including: design of the safety system, installation and maintenance of the components of the safety system, and the cooperation and training of individuals using the safety system. Although the present invention is intended to be highly reliable, all physical systems are susceptible to failure and provision must be made for such failure.

What is claimed is:

1. A distribution box for collecting signals from one or more safety sensors comprising:

(a) a housing having a plurality of electrical connector halves, each connector half presenting first and second input connections, first and second output connections, a status connection and a voltage connection, (b) a signal cable extending from the housing for communicating with a remote device and including safety signal conductors and status signal conductors wherein the safety signal conductors join the connector halves in series from a first connector half to a last connector half so that first and second output connections of connector halves are coupled to the first and second input connections of a next connector half, respectively, until reaching the last connector half, and wherein the status signal conductors pass separately one to each status connection of each connector half separate from the status connection of any other connector half; and (c) a shorting plug adapted to be releasably received by a connector half, wherein the shorting plug couples the first and second input connections of a connector half to the first and second output connections of the connector half, respectively, and couples the status connection of the connector half to the voltage connection of the connector half when the shorting plug is releasably received by a connector half;

wherein each connector half is adapted to either releasably receive a shorting plug, or couple to a safety sensor providing electrical continuity between the first and second input connections of the connector half and the first and second output connections of the connector half, respectively, indicating a valid condition.

2. The distribution box of claim 1, further comprising a remote device communicating with the signal cable, wherein the remote device triggers an alert upon failing to detect electrical continuity of the safety signal conductors.

3. The distribution box of claim 1, further comprising a remote device communicating with the signal cable, wherein the remote device comprises a processor executing software.

4. The distribution box of claim 3, further comprising a remote device communicating with the signal cable, wherein the remote device stores a table indicating the presence or absence of a safety sensor for each connector half presenting a status connection.

5. The distribution box of claim 4, further comprising a remote device communicating with the signal cable, wherein the remote device triggers an alert upon detecting the voltage on a status connection wherein the table indicates the presence of a safety sensor.

6. The distribution box of claim 5, wherein triggering an alert comprises illuminating a light tower.

7. The distribution box of claim 5, wherein triggering an alert comprises sending an electronic mail message.

8. The distribution box of claim 5, wherein the voltage is a positive DC voltage level.

9. The distribution box of claim 5, wherein the voltage is zero.

10. The distribution box of claim 1, further comprising an LED adapted to illuminate upon the status connection receiving the voltage.

11. The distribution box of claim 1, wherein the shorting plug further comprises an LED adapted to illuminate upon the shorting plug coupling the status connection of the connector half to the voltage connection of the connector half when the shorting plug is releasably received by a connector half.

12. The distribution box of claim 1, wherein the housing comprises eight electrical connector halves.

13. A safety sensor monitoring program stored in a non-transitory computer-readable storage medium, wherein the program instructs a processor to perform the following steps:

(a) read a plurality of status connections, each status connection originating from a connector half wherein the status connection of each connector half is separate from the status connection of any other connector half, wherein each connector half is adapted to either releasably receive a shorting plug that couples first and second input connections of the connector half to first and second output connections of the connector half, respectively, and couples a status connection of the connector half to a voltage connection of the connector half, when the shorting plug is releasably received by the connector half, or couple to a safety device providing electrical continuity between the first and second input connections of the connector half and the first and second output connections of the connector half, respectively;

(b) read a table stored in memory indicating the presence or absence of a safety sensor for each connector half presenting a status connection; and (c) trigger an alert upon detecting the voltage on a status connection in which the table indicates the presence of a safety sensor.

14. The monitoring program of claim 13, further comprising triggering an alert upon failing to detect electrical continuity between first and second input connections of a connector half and first and second output connections of a connector half, respectively.

15. The monitoring program of claim 13, wherein the voltage is a positive DC voltage level.

16. The monitoring program of claim 13, wherein the voltage is zero.

17. The monitoring program of claim 13, wherein triggering an alert comprises sending an electronic mail message.

18. A safety distribution system for monitoring one or more safety sensors comprising:

(a) an adapter port receiving a plurality of safety signal input conductors at a first connector half, a plurality of safety signal input conductors at a second connector half and a plurality of safety signal input, conductors at a third connector half, and coupling the safety signal input conductors from the first connector half to safety signal output conductors at the second connector half, the safety signal input conductors from the second connector half to safety signal output conductors at the third connector half and the safety signal input conductors from the third connector half to safety signal output conductors at the first connector half; and (b) a cable with a first cable end and a second cable end for carrying a plurality of safety signal input conductors and a plurality of safety signal output conductors, wherein each of the first and second cable ends are of the same type, and the first and second cable ends are each adapted to couple to either the first connector half or the second connector half of the adapter port.

* * * * *